US008235626B2

(12) United States Patent
Sonck et al.

(10) Patent No.: US 8,235,626 B2
(45) Date of Patent: Aug. 7, 2012

(54) ADJUSTABLE SYSTEM AND METHOD FOR CARRYING OUT WORK AT AN UNDERWATER STRUCTURE

(75) Inventors: Willy Sonck, Denderleeuw (BE); Eric Van Draege, Lokeren (BE)

(73) Assignee: General Coatings N.V., Erembodegem (BE)

( * ) Notice: Subject to any disclaimer, the term of this patent is extended or adjusted under 35 U.S.C. 154(b) by 332 days.

(21) Appl. No.: 12/558,711

(22) Filed: Sep. 14, 2009

(65) Prior Publication Data

US 2010/0067986 A1 Mar. 18, 2010

(30) Foreign Application Priority Data

Sep. 16, 2008 (GB) ..... 0816940.1

(51) Int. Cl.
*E02D 19/04* (2006.01)

(52) U.S. Cl. ..... 405/11; 405/14

(58) Field of Classification Search ..... 405/11, 405/12, 14, 8–10, 13
See application file for complete search history.

(56) References Cited

U.S. PATENT DOCUMENTS 55,235 A * 6/1866 Braidwood ..... 405/14
4,696,597 A * 9/1987 Sonck ..... 405/12
5,292,206 A * 3/1994 Sonck et al. ..... 405/12
5,595,459 A * 1/1997 LoMonaco ..... 405/272

FOREIGN PATENT DOCUMENTS

EP 0203641 A2 12/1986
EP 0 533 649 A1 3/1993
GB 2226843 A 7/1990
GB 2 276 407 A 9/1994

OTHER PUBLICATIONS

Search Report of British Patent Office regarding British Patent Application No. GB0816940.1, Dec. 3, 2008.
Extended Search Report regarding European Patent Application No. 09169759.9, Feb. 1, 2010.
Communication of EPO regarding European Patent Application No. 09169759.9, Oct. 12, 2010.

* cited by examiner

*Primary Examiner* — Tara Mayo-Pinnock
(74) *Attorney, Agent, or Firm* — Bacon & Thomas, PLLC

(57) ABSTRACT

A dry setting installation (1) for generating a substantially dry working space for carrying out work at an underwater structure. The dry setting installation (1) has two side-walls (2), a back wall (3) and a bottom (4) thus forming a cofferdam. The dry setting installation furthermore has, for each side-wall, a side edge sealing (20) provided on the side-wall (2) edge for providing a substantially sealing contact between the side-walls (2) and the underwater structure. The dry setting installation also has a distance variation system (30) for varying the distance between the side edge sealing system (20) of the two side-walls (2).

13 Claims, 5 Drawing Sheets

ADJUSTABLE SYSTEM AND METHOD FOR CARRYING OUT WORK AT AN UNDERWATER STRUCTURE

CROSS-REFERENCE TO RELATED PATENT APPLICATIONS

This application claims the benefit of British Application No. GB 0816940.1 filed Sep. 16, 2008, which is also incorporated by reference.

TECHNICAL FIELD OF THE INVENTION

The present invention relates to the field of under water structures, such as for example a steel wall. More particularly, the present invention relates to adjustable systems and methods for carrying out, under substantially dry conditions, control, maintenance or repair works of surfaces below water.

BACKGROUND OF THE INVENTION

Sheet pile walls can be used for quay walls, marine constructions, piers, Duc d'Alben, embankments, other constructions for harbours, waterways, etc. They typically are made of steel sheets. As such constructions are at least partly positioned under water, such walls are subject to corrosion.

In order to perform maintenance or control works at these walls, for example to check a level of corrosion of the wall, perform treatment of the wall against corrosion or replace or repair parts of the wall, it can be useful to make the walls easily accessible in a dry environment. Dry setting installations, also referred to as cofferdams or caissons, allow to create such free access to the site in a dry environment. Such installations may be built up from a bottom, a vertical back surface and two lateral side-walls. In order to create a substantially dry environment, sealing at the vertical contact edges of the installation with the steel wall and sealing at the bottom surface edge between the installation and the steel wall may be present. Such sealing preferably needs to follow the profile of the steel wall in order to provide a sufficient sealing and thus to create a sufficiently dry environment.

When using or positioning dry setting installations, vertical oriented walls of the dry setting installation, including their sealings, should be arranged such that they are supported on extending parts of the sheet pile wall, e.g. extending parts of the profiles or piles. Dry setting installations typically are manufactured to fit the profile of the wall to be worked on, i.e. to fit the particular configuration of extending parts and indentations created by the type of steel sheet and pile used. Consequently, when works are to be performed at a different sheet pile wall having a different profile or at a sheet pile wall built up of a plurality of types of steel sheets having different profiles, one or more different dry setting installations need to be made. If a non-custom-made dry setting installation is used on a different wall with a different profile having larger or smaller extending parts or indentations, a vertical side-wall, also referred to as (lateral) side-wall of the dry setting installation may be in a position such that it does not join the profile of the sheet pile wall, thus resulting in difficulties for creating a dry environment.

Building different types of dry set installations is time and material consuming as well as labour intensive.

SUMMARY OF THE INVENTION

It is an object of embodiments of the present invention to provide good apparatus or methods for allowing carrying out work at different types of underwater structures. It is an advantage of embodiments of the present invention that dry setting installations and methods for manufacturing and using them are provided that can be applied for a variety of types of sheet pile walls, for example sheet piled walls build up of different types of steel sheet profiles or piles.

It is an advantage of embodiments according to the present invention that dry setting installations are obtained that have adjustable vertical sealing means, so that they can be re-used for sheet pile walls having different steel piles. As such dry setting installations can be applied for differently shaped walls, the overall number of dry setting installations to be manufactured can be reduced. The latter can, over time, result in a significant reduction of raw materials required.

It is an advantage of embodiments according to the present invention that dry setting installations and methods for using them are provided allowing to obtain a gain in time, as instead of constructing a completely new dry setting installations when a new wall type profile is to be handled, the existing dry setting installation can be adapted in an easy way.

It thereby is an advantage that the time required for development and construction of new dry setting installations can be reduced or even avoided, as well as the costs in connection therewith. It is an advantage of embodiments according to the present invention that strength calculations for adjustable dry setting installations only need to be performed a single time, resulting in a dry setting installation that can be used for a plurality of differently profiled steel pile walls.

The above objective is accomplished by a method and device according to the present invention.

The present invention relates to a dry setting installation for generating a substantially dry working space for carrying out work, e.g. control or maintenance work, at an underwater structure. The dry setting installation comprises two side-walls, a back wall, a bottom and, for each side-wall, a side edge sealing means provided on the side-wall edge for providing a substantially sealing contact between the side-walls and the underwater structure. It is characterised in that the dry setting installation comprises a distance variation means for varying the distance between the side edge sealing means of the two side-walls. It is an advantage according to embodiments of the present invention that the dry setting installation is adjustable in width, thus allowing to fit different types of underwater structures, e.g. different types of sheet pile walls build up of different steel sheet profiles.

The distance variation means may be adapted for varying the distance between the side edge sealing means of the two side-walls over at least 4 cm, e.g. over at least 10 cm, and up to at least 70 cm or up to at least 80 cm or more. It is an advantage of embodiments according to the present invention that the dry setting installation is adjustable to steel sheet pile walls constructed from sheet plates having one of the conventionally used sheet profiles.

The distance variation means for varying the distance between the side edge sealing means of the two side-walls may comprise a spacing variation means for varying the spacing between the two side-walls.

The spacing variation means may comprise a means for varying the position of at least one of the side-walls with respect to the bottom.

The means for varying the position of at least one of the side-walls with respect to the bottom may comprise an additional positioning element fixed to the at least one side-wall and provided with an extending portion so as to fit in one of a plurality of grooves provided at predetermined distances in the bottom.

The means for varying the position of at least one of the side-walls with respect to the bottom may comprise an additional positioning element fixed to the at least one side-wall and adapted to provide a shiftable connection with a groove in the bottom for connecting the at least one side-wall to the bottom.

The spacing variation means may comprise at least one of an adjustable bottom and/or an adjustable back wall adjustable in length in its length direction.

The adjustable bottom and/or the adjustable back wall may be built up of segments and the length of the bottom and/or back wall may be adjustable by adding or removing the segments.

The distance variation means for varying the distance between the side edge sealing means of the two side-walls may comprise a position variation means for varying the relative position of at least one side edge sealing means with respect to its side-wall. It is an advantage of embodiments according to embodiments of the present invention that construction can be easily made.

The position variation means may be adapted for varying a relative position of the side edge sealing means with respect to a seal support, the seal support being fixedly connected to the side-wall.

The position variation means may be adapted for varying a relative position of the seal support with respect to its side-wall, the seal being fixedly connected to the seal support.

The present invention also relates to a method for obtaining a substantially dry working environment at an underwater structure, the method comprising obtaining an adjustable dry setting installation, setting a width of the adjustable dry setting installation by adjusting a distance between side edge sealing means suitable for providing a sealing contact between side-walls and a wall of the underwater structure, and positioning the dry setting installation at the wall of the underwater structure.

Setting a width may be performed prior to positioning of the dry setting installation.

The installation is especially suitable for performing works at a steel pile planking wall below water level.

Features from the dependent claims may be combined with features of the independent claims and with features of other dependent claims as appropriate and not merely as explicitly set out in the claims.

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

BRIEF DESCRIPTION OF THE DRAWINGS

FIG. 5*c*(ii) is a schematic illustration of a dry setting installation according to FIG. 5*a*, wherein the side-wall is positioned with a positioning element within a groove in the bottom according to an example of the third particular embodiment.

Figure 1:
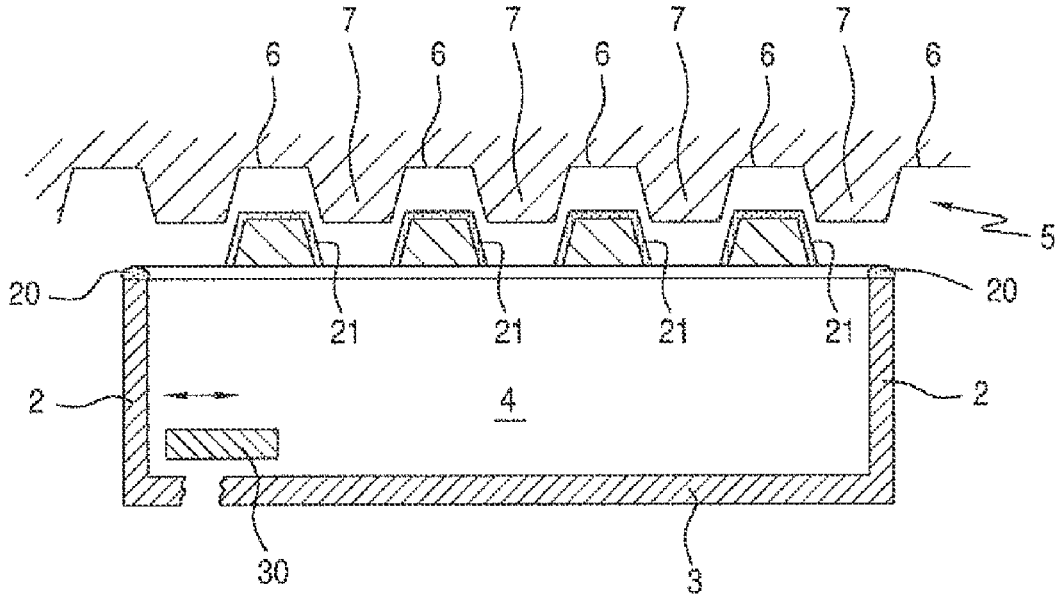
FIG. 1 is a schematic representation of a top view of a dry setting installation according to an embodiment of the present invention.

In the different figures, the same reference signs refer to the same or analogous elements.

DESCRIPTION OF ILLUSTRATIVE EMBODIMENTS

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments of the invention described herein are capable of operation in other sequences than described or illustrated herein.

Moreover, the terms vertical, horizontal, top, bottom, and the like in the description and the claims are used for descriptive purposes. They refer to the orientation of the different components for an orientation of the dry setting installation as in use against a steel pile wall.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Furthermore, some of the embodiments are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the invention.

In the description provided herein, numerous specific details are set forth. However, it is understood that embodiments of the invention may be practiced without these specific details. In other instances, well-known methods, structures and techniques have not been shown in detail in order not to obscure an understanding of this description.

The following terms are provided solely to aid in the understanding of the invention. With substantially liquid-tight there is meant that a sealing is at least sufficiently liquid tight so as to be able to generate a working space free of liquid, optionally upon assistance of a pumping means or pump. With widthwise direction of the dry setting installation there is meant the direction substantially perpendicular to the two lateral side-walls of the dry setting installation.

The invention will now be described by a detailed description of several embodiments of the invention. It is clear that other embodiments of the invention can be configured according to the knowledge of persons skilled in the art without departing from the true spirit or technical teaching of the invention, the invention being limited only by the terms of the appended claims.

In a first aspect, the present invention relates to a dry setting installation for creating a substantially dry environment for performing work at an underwater construction, such as sheet pile wall like a quay wall, a pier, a Duc d'Alben, an embankment, etc. The sheet pile wall may be a steel sheet pile wall, although the invention is not limited thereto. Such a dry setting installation may create free access to the site in a substantially dry environment, such that inspection, maintenance or repair works of surfaces, such as for example steel surfaces, can be performed below the water surface. The latter may be performed with low or minimum disturbance to the activities on or in the water, e.g. harbour activities. The dry setting installation also may be referred to as DZI, caisson or cofferdam. The dry setting installation according to embodiments of the first aspect comprises a bottom, two lateral side-walls, also referred to as lateral walls or side-walls, and a back wall. When in use, the two lateral side-walls and the back wall may be oriented vertically, whereas the bottom typically will be oriented horizontally. The dry installation furthermore comprises a side edge sealing means at each of the edges of the two lateral side-walls facing the sheet pile wall. The side edge sealing means is suitable for providing a substantially sealing contact between the lateral side-walls of the dry setting installation and the wall to be examined, maintained or treated. Advantageously, also a bottom edge sealing means for providing a sealing contact between the edge of the bottom of the dry setting installation and the wall may be provided. According to the first aspect, embodiments according to the present invention are adapted for varying the distance between the two side edge sealing means of the dry setting installation. More particularly, the system is adapted for varying the distance between a first side edge sealing means present at an edge of the first lateral side-wall and a second side edge sealing means present at an edge of the second lateral side-wall. The latter advantageously allows to adjust the dry setting installation in width, such that it can be used for walls with different profiles, e.g. for walls with different spacing between extending parts or piles.

By way of illustration, the present invention not being limited thereto, a dry setting installation according to an exemplary embodiment of the present invention is shown in FIG. 1. FIG. 1 illustrates an exemplary dry setting installation 1 with three vertical walls, i.e. two lateral side-walls 2, also referred to as lateral walls, and a back wall 3, also referred to as rear wall. The dry setting installation 1 furthermore comprises a bottom 4. Orientation of the different components is described with respect to the substantial orientation of the components when the dry setting installation is in operation, i.e. when it is placed in a position so as to be able to work on a steel pile wall 5. Such a steel pile wall 5 may comprise indentations 6 and extending parts 7, for example present due to the profiles of the sheet piles used. The dry setting installation is open along the front side, i.e. the side directed towards the wall 5 to be examined, treated or maintained.

The edges of the lateral side-walls 2 facing the sheet pile wall 5 to be treated (when the dry setting installation 1 is in position) are provided with side edge sealing means 20, also referred to as side edge sealing or side edge seal, so as to provide a suitable sealing contact between the lateral side-walls 2 of the dry setting installation 1 and the wall 5 to be treated, maintained or examined. Such a sealing means 20 may for example be a liquid-tight sealing such as a watertight sealing, a substantially liquid-tight sealing or a sealing that seals sufficiently so that sufficient liquid passing sealings of the dry setting installation 1 can be pumped away during operation, allowing to create a substantially dry working environment. The sealing means 20 may for example be formed of strips made of foam rubber or a similar elastic sealing material, although the invention is not limited thereto. Advantageously, bottom edge sealing means 21 are also provided to the edge of the bottom 4, so as to provide a suitable sealing contact between the bottom 4 and the wall 5 to be treated.

Figure 2:
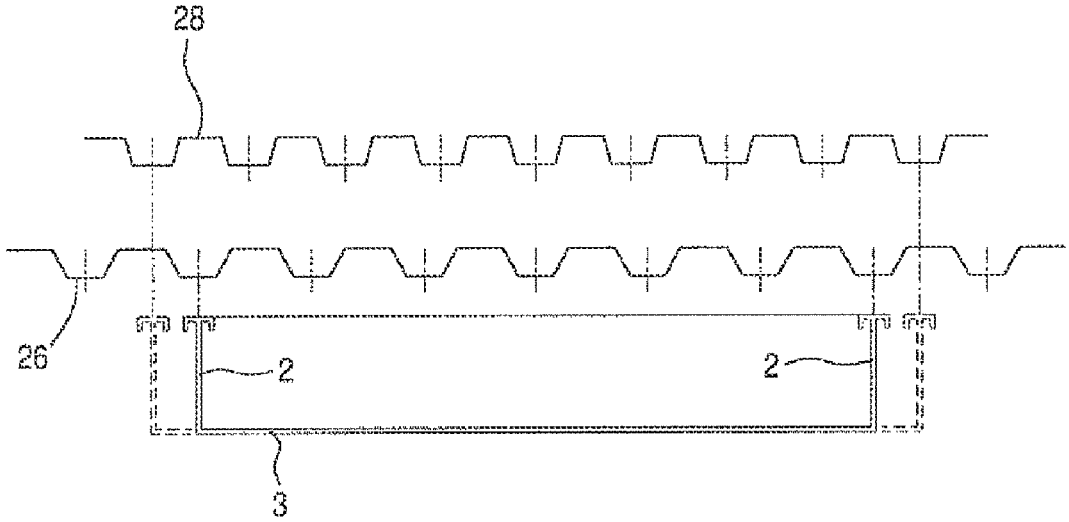
FIG. 2 (Prior Art)
FIG. 2 is a schematic illustration of a problem of fitting conventional dry setting installations to sheet pile walls built up of different sheet profiles, as can be solved using an embodiment of the present invention.

According to an aspect of the present invention, the dry setting installation 1 furthermore is adapted with a side-edge-sealing-distance-variation-means 30 (schematically represented in the first drawing) for varying the distance between the side edge sealing means 20 at each of the lateral side-walls 2. The distance between the side edge sealing means 20 may for example be varied by varying the relative position of the side edge sealing means 20 with respect to the lateral side-walls 2 on which they are positioned, or by varying the relative position of the lateral side-walls 2 with respect to each other. The distance-variation-means 30 may be adapted for varying the distance between the side edge sealing means 20 in a stepwise manner or in a continuous manner. It may be adapted for varying the distance before use of the dry setting installation 1, i.e. for example when the dry setting installation is on the quay and not positioned at the sheet pile wall yet. It is an advantage of embodiments according to the present invention that the dry setting installation can be adapted in width, i.e. in distance between the side edge sealing means 20, so that a more or less general dry setting installation can be adapted to different types of profiles of the sheet pile wall, i.e. for example to different types of steel sheet profiles used for creating the sheet pile wall. The distance-variation-means 30 thus allows to deal with sheet pile walls built up from sheets with a different profile, which is not possible with conventional dry setting installations according to the prior art. The latter is illustrated in FIG. 2 showing two dry setting installations, one in full line, one in dashed line, the dry setting installation in full line being adapted for operation at a first sheet pile wall as illustrated by the sheet pile wall 26 illustrated in the middle of FIG. 2, the dry setting installation 1 in dashed line being adapted for operation at a second sheet pile wall as illustrated by the sheet pile wall illustrated at the top of FIG. 2, profile 28. It can be seen that the dry setting installation for one sheet pile wall profile is not directly suitable for another sheet pile wall profile. By using a distance-variation-means 30, a single dry setting installation can be adapted for operation at different steel pile walls having different types of profiles. The distance-variation-means 30 can be obtained in a variety of ways, some of them by way of example illustrated in particular embodiments set out below, the invention not being limited thereto.

Optionally, the present invention not being limited thereto, the dry setting installation 1 may be provided with a means for keeping the dry setting installation in contact with the wall (not shown) and for providing a sealing contact. The dry setting installation 1 therefore may be adapted with a structure at the bottom 4, allowing to keep the bottom pressed to the sheet pile wall 5. The dry setting installation 1 may be provided with a beam (not shown) such that a transverse displacement of the bottom 4 with respect to the beam can be performed. Such a beam may be made of links, linking interconnects, so that the links and interconnects can adapt to the profile of the steel pile wall and allow to form contact between the bottom 4 and the sheet pile wall 5. The system furthermore may comprise features and components of the system as specified in EP0203641, incorporated herein by reference, embodiments of the invention not being limited thereby.

Another optional feature, the present invention not being limited thereto, refers to the sealing means 21 for providing a sealing between the bottom 4 and a profiled steel sheet wall 5. The profiled steel sheet wall 5 may show some variations from standard positions of extensions 7 or indentations 6, and the bottom edge sealing means 21 may comprise features (not shown) for providing a substantially watertight liquid tight sealing, adaptable to such variations. Features and advantages, such a deformable sealing means, a pressure providing means such as for example an inflatable chamber, etc. as described in EP0203641 may be obtained using a system or components as described therein, the teaching thereof being incorporated by reference. Nevertheless, such features are optional, embodiments of the present invention not being limited thereby.

Other optional components that may be present in a dry setting installation according to the present invention may be a pumping installation, for dewatering installation in preparation for use or use of the dry setting installation.

By way of illustration, the present invention not being limited thereto, a plurality of particular embodiments indicating exemplary different distance variation means are discussed below.

According to a first set of particular embodiments, a dry setting installation 1 as described above is provided, wherein the distance-variation-means 30 for varying the distance between a first side edge sealing means 20 at a first lateral side-wall 2 and a second side edge sealing means 20 at a second lateral side-wall 2, comprises a position-variation-means 40 for varying the relative position of at least one of the side edge sealing means 20 with respect to its lateral side-wall 2. The variation in distance between the side edge sealing means 20, also referred to as the width extension, that may be obtainable advantageously is at least a few cm, such as at least 4 cm or at least 10 cm, and may be e.g. up to 70 cm, e.g. up to 80 cm or more. The latter allows fitting the dry setting installation 1 to sheet pile walls, independent of which type of profile is used for the sheet pile wall construction. In some embodiments, such variation of the relative position may be performable for one side edge sealing means 20, whereas for other embodiments both side edge sealing means 20 may be variable in relative position. In this case, the distance-variation-means 40 may comprise two components, one for each side edge sealing means 20. It may be an advantage to have both side edge sealing means 20 variable in relative position, as the overall variation in the position between the side edge sealing means 20 may be split into smaller variations for both side edge sealing means 20. The latter may be advantageous in view of constructional or strength aspects.

Figure 3:
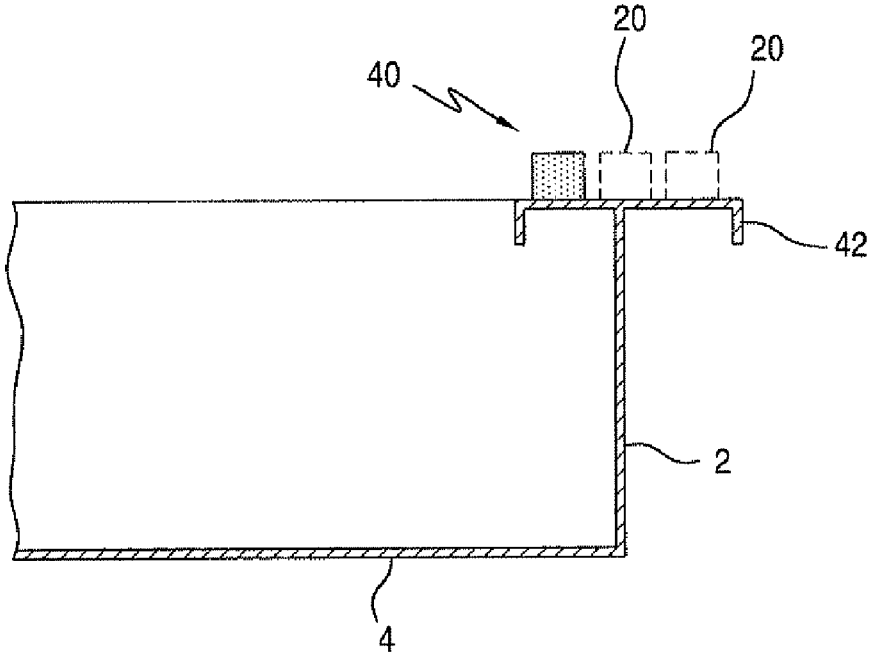
FIG. 3 is a schematic illustration of an adjustable dry setting installation wherein the relative position of a seal can be varied with respect to a seal support according to a first particular embodiment of the present invention.

An illustration of one embodiment according to the first set of embodiments is shown in FIG. 3. It describes a position-variation-means 40 for varying the relative position of at least one of the side edge sealing means 20 wherein the sealing means 20 can be varied in position with respect to a seal support 42. According to the present embodiment, the side edge sealing means 20 can be positioned at different relative positions with respect to the seal support 42. The latter may be obtained by providing a seal support 42 that extends in a width direction of the dry setting installation so that different relative positions for the side edge sealing means 20 are present on the seal support 42. The side edge sealing means 20 may be connectable to the seal support 42 in any suitable manner, such as for example through nut and bolt, using screws, using glueing, etc. The position variation of the side edge sealing means 20 with respect to the seal support 42 may be provided in a continuous way, e.g. by making the seal shiftable with respect to the seal support, e.g. in a groove. Alternatively, the position variation of the side edge sealing means 20 with respect to the seal support 42 may be provided in a stepwise manner, e.g. by providing different fixing positions. In one particular example different holes are provided in the seal support 42 in a direction along the width direction of the dry setting installation, so as to provide different fixation points for the side edge sealing means 20 with respect to the seal support 42. Holes not used for the fixation, may be closed using any type of sealing components or products. In FIG. 3 the example of three different fixation positions for a sealing means 20 with respect to the seal support 42 is shown, whereby the side edge sealing means 20 is indicated at the left hand side, but optional positions of the side edge sealing means 20 also can be found in the middle or at the right hand side, as indicated. According to the present particular embodiment, the seal support 42 may be fixedly connected to the lateral side-wall 2.

Figure 4:
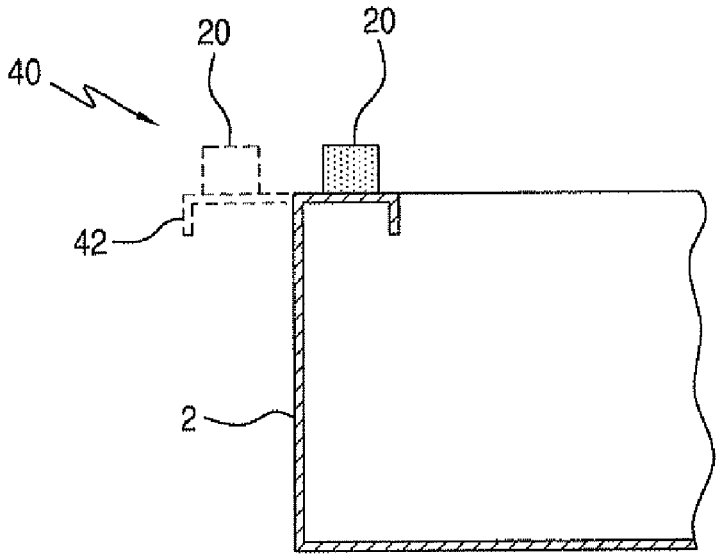
FIG. 4 is a schematic illustration of an adjustable dry setting installation wherein the relative position of a seal support can be varied with respect to a lateral side-wall according to a second particular embodiment of the present invention.

FIG. 4 illustrates another exemplary embodiment according to the first set of embodiments, wherein sealing is performed using a side edge sealing means 20 fixed on a seal support 42. According to the present particular embodiment, the seal is mounted in a fixedly manner to the seal support 42, but the seal support 42 can be fixed at different relative positions with respect to the lateral side-wall. By way of illustration FIG. 4 illustrates two different positions, one in full line, one in dashed line, for the seal support 42 with respect to the lateral side-wall. The side edge sealing means 20 is shown at the same relative position with respect to the seal support 42. The side edge sealing means 20 may be fixedly connected for example using a glue or using nuts and bolts and holes at predetermined positions. In order to provide such different relative positions between the seal support 42 and the lateral side-wall 2, a connection means providing such an adjustable connection between the seal support 42 and the lateral side-wall 2 may be provided. In one embodiment, a plate can be fixed to the edge of the lateral side-wall in a direction substantially perpendicular thereto, thus being substantially parallel with the sheet pile wall 5 when in use. The plate may comprise two guiding rails provided, e.g. at the top and the bottom with respect to the lateral side-wall. Within such rails, a seal support 42 can be guided such that the seal support can take a variety of positions along the widthwise direction of the dry setting installation. The latter allows a continuous variation of the position of the side edge sealing means 20. In order to further make the dry setting installation watertight additional sealing can be provided between the plate and the seal support using any suitable sealing means. The position of the seal support 42 optionally further fixed using for example clamps. Alternatively, different fixing means may be provided for fixing the seal support 42 with respect to the plate and the rails at different predetermined positions, resulting in a stepwise like system. Such fixing means may comprise a set of holes allowing to fix the seal support 42 at different relative positions to the lateral side-wall 2, e.g. using nuts and bolts or screws, etc.

According to a second set of particular embodiments, a dry setting installation as described above is provided, but wherein the distance-variation-means 30 for varying the distance between a first side edge sealing means 20 at a first lateral side-wall 2 and a second side edge sealing means 20 at a second lateral side-wall 2 comprises a spacing-variation-means 50 for varying the spacing between the first lateral side-wall 2 and the second lateral side-wall 2 whereon the side edge sealing means 20 are mounted, consequently resulting in a variation in distance between the side edge sealing means 20. The latter can be obtained in a number of ways, some examples thereof being described below by way of illustration.

Figure 5A:
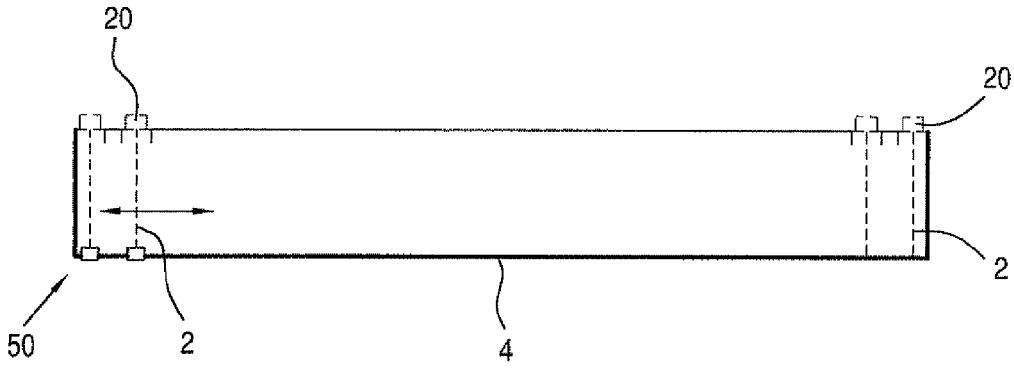
FIG. 5*a* is a schematic illustration of an adjustable dry setting installation wherein the relative position of a side-wall can be varied with respect to a bottom and back wall according to a third particular embodiment of the present invention.
Figure 5B:
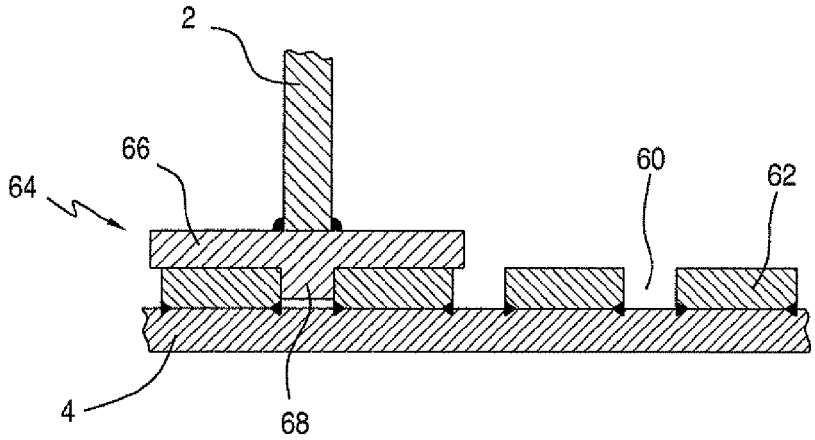
FIG. 5*b* is a schematic illustration of a dry setting installation according to FIG. 5*a*, wherein the side-wall can be positioned at different predetermined positions according to an example of the third particular embodiment.

In one exemplary embodiment according to the second set of particular embodiments, the spacing-variation-means 50 for varying the distance between the first lateral side-wall 2 and the second lateral side-wall 2. In a first embodiment is a means for varying the position of at least one side-wall 2 and optionally both of the side-walls 2 with respect to the bottom 4 and the back wall 3. The relative position of at least one of the lateral side-walls 2 may be varied in a continuous manner or a in a stepwise manner. The at least one lateral side-wall 2 may be moveably mounted such that it can shift with respect to the bottom 4 and the back wall 3, e.g. prior to use. The appropriate position of the at least one side-wall may be selected and set before use, and the at least one side-wall may be fixed to the bottom 4 using any suitable fixation means. In an alternative example, the position of the side-wall 2 with respect to the bottom 4 may be varied between discontinuous, predetermined, positions by selecting one of a set of predetermined connection holes or fixation features for fixing the side-wall to the bottom 4, the connection holes or fixation features being positioned at different positions in a widthwise direction of the dry setting installation 1. In one example, the bottom 4 is provided with a number of rows of connection holes, each row being oriented along a depth-wise direction along the bottom 4, i.e. perpendicular to the back wall, whereby fixation of the side-wall may be performed using nuts and bolts. A substantial liquid-tight sealing may be obtained by providing a sealing means at the edge of the at least one side-wall in contact with the bottom 4 and the back wall. FIG. 5*a* illustrates a schematic representation of a dry setting installation wherein the left side-wall can be varied in relative position. The variation in spacing between the side-walls, also referred to as the width extension, that may be obtainable advantageously is at least a few cm, for example at least 4 cm, or at least 10 cm e.g. up to 70 cm, e.g. up to 80 cm or more. The latter allows fitting the dry setting installation 1 to sheet pile walls, independent of which type of profile is used for the sheet pile wall construction. In some embodiments, such variation of the relative position may be performable for one lateral side-wall 2, whereas for other embodiments both lateral side-walls 2 may be variable in relative position. It may be an advantage to have both side-walls 2 variable in relative position, as the overall variation in the position between the side-walls 2 may be split into smaller variations for both side-walls 2, which may result in constructional advantages. One characteristic of the dry setting installation according to the present embodiment is that the bottom 4 and back wall may have a length that is substantially longer than the distance between the side-walls 2 used in conventional dry setting installations, such that extension in a widthwise direction of the dry setting installation can be obtained. In use, the bottom and the back wall 3 thus may extend outside the volume of the dry setting installation intended to create a substantially dry working environment. By way of illustration, embodiments according to the present invention not being limited thereto, FIG. 5*b* illustrates an example of a system wherein at least one lateral side-wall 2 can be varied. The latter illustrates a bottom 4 (or correspondingly a back wall 3) whereon grooves 60 are provided, e.g. by welding metal beams 62 to the bottom 4 at predetermined positions. The lateral side-wall 2 to be positioned or re-positioned then may be provided with an additional positioning element 64 for appropriately positioning the lateral side-wall 2 with respect to a selected groove 60. The additional positioning element 64 may for example comprise a first plate 66 perpendicular to the surface of the lateral side-wall 2 and suitable for being positioned adjacent the beams 62 and an extending part 68 adapted in shape so as to fit in the selected groove 60. This example, embodiments of the present invention not limited thereto, results in a predetermined discontinuous positions being available for the lateral side-wall.

Figure 5C:
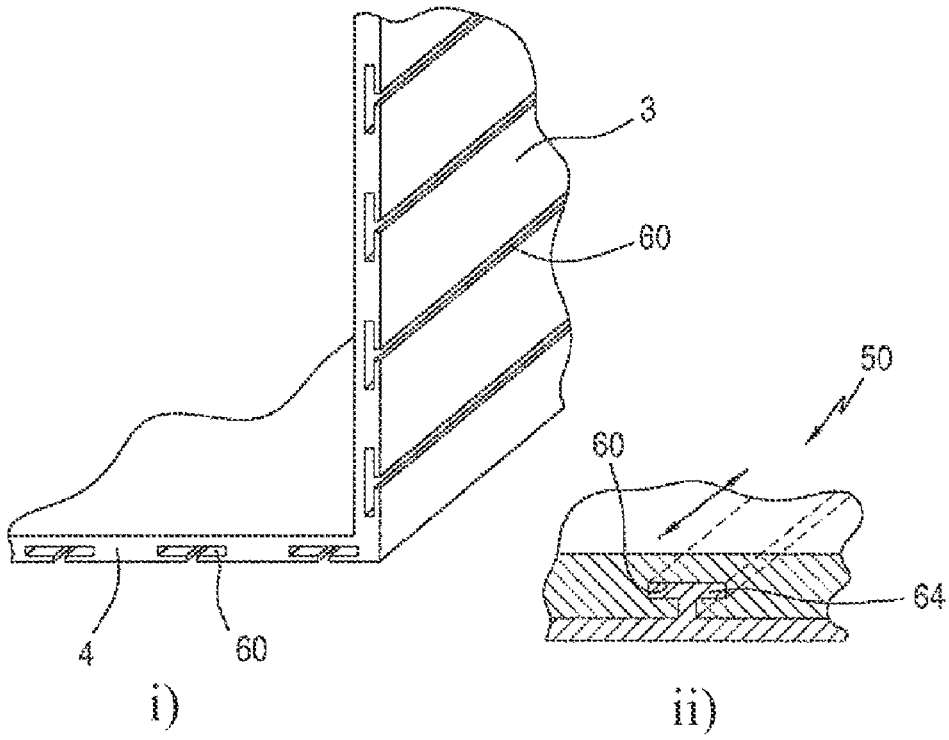
FIG. 5*c*(i) is a schematic illustration of a dry setting installation according to FIG. 5*a*, wherein the side-wall can be positioned at variable continuous positions according to an example of the third particular embodiment.

FIG. 5*c* illustrates another example of a system wherein at least one lateral side-wall 2 can be varied, in the present example at continuously varying positions. In the example, the bottom 4 and side-wall 3 of the dry setting installation 1 are provided with fixation grooves 60 extending continuously along a widthwise direction of the dry setting installation 1, whereby the edges of the lateral side-wall 2 are provided with additional positioning elements 64 that are adapted in shape so as to cooperate with the fixation grooves 60 to provide a sliding fixation between the bottom 4 or back wall 3 and the lateral side-wall 2. The lateral side-wall then may be fixed at selected positions using any type of fixation means such as clamps, etc.

Figure 6:
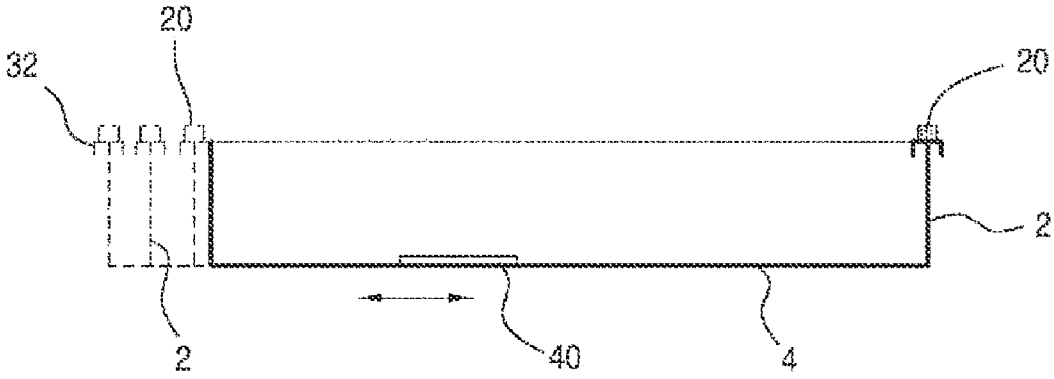
FIG. 6 is a schematic illustration of an adjustable dry setting installation wherein the bottom and back wall are extendable in length, according to a fourth particular embodiment of the present invention.
Figure 7:
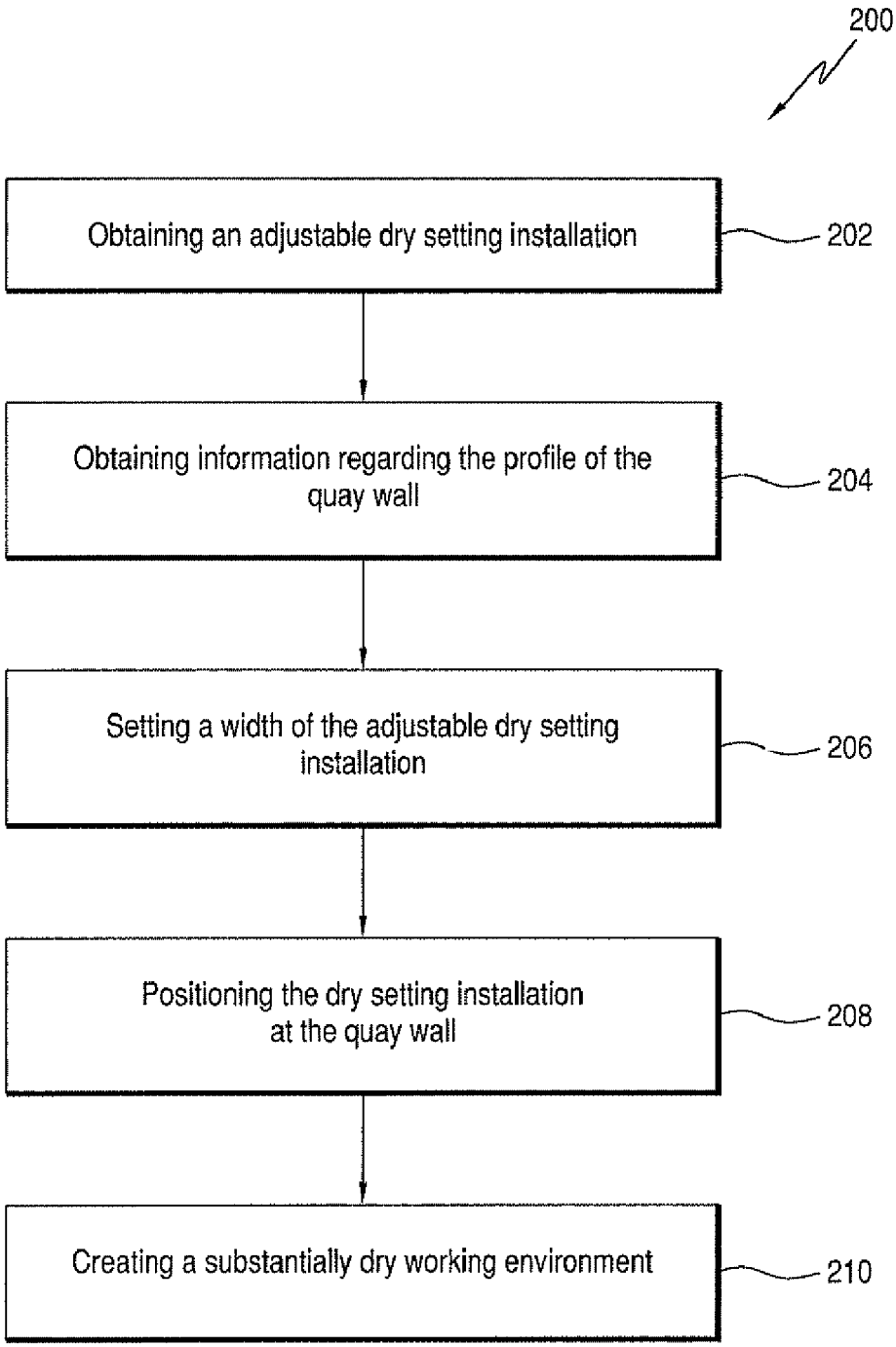
FIG. 7 is a schematic illustration of a method for using an adjustable dry setting installation according to an embodiment of the present invention.

In another exemplary embodiment, the spacing-variation-means 50 for varying the spacing between the side-walls comprises a means for varying the length of the bottom 4 and/or the back wall 3 between the side-walls 2. The system therefore may be adapted so that the bottom 4 and/or the back wall can be extended in a width-wise direction of the dry setting installation, the bottom 4 and/or the back wall 3 thus behaving as telescopic walls. If only one of the bottom 4 and the back wall 3 is adapted for being telescopic, the relative position of the side-wall with respect to the other non-telescopic wall may be variable using a system as described in the previous example. A means for varying the length of the bottom 4 and/or the back wall may provide extension in a continuous or stepwise manner. By way of illustration, the present invention not being limited thereto, FIG. 6 illustrates a schematic example of a dry setting installation wherein the bottom and back wall are telescopic. The variation in distance between the side-walls 2, also referred to as the width extension, that may be more than a few cm, such as for example more than 4 cm or more than 10 cm and may reach up to 70 cm, or up to 80 cm or more. The latter allows fitting the dry setting installation 1 to sheet pile wall, independent of which type of profile is used for the steel pile wall construction. In one example, the bottom 4 and/or back wall 3 is built up of different segments having a width in a width-wise direction of the dry setting installation, i.e. along the length direction of the bottom 4 and/or back wall 3. The length variation of the bottom 4 and/or back wall 3 then is obtained by providing more or less segments in the bottom 4 and/or back wall 3. One other example of a telescopic wall as can be used according to an embodiment of the present invention comprises two partly profiled plates with a plurality of structural features such as grooves and extensions provided in a width-wise direction of each of the plates, so that parts of the plates can overlap over a variable distance and be positioned in contact with each other over that distance by virtue of a complementary shape of the structural features in both plates. A length of the telescopic wall then can be selected by varying the number of grooves and extensions by which the plates forming the telescopic wall overlap. By providing the grooves and extensions with their length direction perpendicular to the direction wherein the wall can extend, a substantially liquid tight sealing can be obtained by conventional fixing means for fixing the plates to each other, e.g. using nuts and bolds.

Whereas the above particular embodiments have been illustrated each showing one example of a means for varying the distance between the side edge sealing means, embodiments also may combine a number of distance variation means for varying the distance between the side edge sealing means.

In a second aspect, the present invention relates to a method of using an adjustable dry setting installation. The method thereby is characterised in that it comprises a step of adjusting the distance between side edge sealing means at the edges of the side-walls of the dry setting installation, suitable for providing a substantially liquid tight sealing between the side-walls and the steel pile wall to be studied, maintained or treated. By way of illustration, the present invention not being limited thereto, an exemplary method 200 according to an embodiment of the present invention is provided.

The method may comprise obtaining 202 an adjustable dry setting installation, adjustable in a width wise direction, i.e. adjustable in length between the sealing means at the edge of the side-walls. The latter may comprise obtaining an adjustable dry setting installation as described in the first aspect or any or a combination of its embodiments.

The method also may comprise obtaining 204 information regarding the profile of the steel pile wall to be worked on, so as to obtain information regarding the required width for the adjustable dry setting installation. The latter may be measured or determined in any suitable way or such information may already be available upfront.

The method according to embodiments of the present invention comprises setting 206 a width of the adjustable dry setting installation in agreement with a profile of the steel pile wall to be worked on. The latter is performed by varying the distance between the side edge sealing means, for example by changing the position of the side edge sealing means with respect to the side-walls or by varying the distance between the side-walls. Setting a width may be performed by adjusting the position of one or more seals with respect to their seal support, by adjusting the position of one or more seal supports with respect to their side-wall, by varying a position of one or more side-walls with respect to the bottom 4 and back wall or by varying a length of the bottom 4 or back wall, or by any combination thereof, in agreement with the means for varying the distance between the side edge sealing means used. The latter preferably is performed prior to positioning the dry setting installation in the liquid, for example at the quay.

The method thereafter comprises positioning 208 the dry setting installation at the steel pile wall and creating 210 a substantially dry working environment, e.g. by pumping liquid out of the dry setting installation. Positioning the dry setting installation may comprise standard and/or optional features such as providing a firm contact between the bottom 4 and the steel pile wall, adjusting a bottom edge sealing means to the steel pile wall, etc.

It is to be understood that although preferred embodiments, specific constructions and configurations, as well as materials, have been discussed herein for devices according to the present invention, various changes or modifications in form and detail may be made without departing from the scope of this invention as defined by the appended claims. Functionality may be added or deleted from the block diagrams and operations may be interchanged among functional blocks. Steps may be added or deleted to methods described within the scope of the present invention.

We claim:

1. A dry setting installation for generating a dry working space for carrying out work at an underwater structure, the dry setting installation comprising:

two side-walls, a back wall, a bottom and, for each side-wall, a side edge sealing provided on the side-wall edge arranged to provide a sealing contact between the side-walls and the underwater structure, wherein the dry setting installation comprises a distance variation system for varying the distance between the side edge sealing of the two side-walls.

2. The dry setting installation according to claim 1, wherein the distance variation system is arranged for varying the distance between the side edge sealing of the two side-walls over at least 4 cm.

3. The dry setting installation according to claim 1, wherein the distance variation system for varying the distance between the side edge sealing of the two side-walls comprises a spacing variation system for varying the spacing between the two side-walls.

4. The dry setting installation according to claim 3, wherein the spacing variation system comprises a system for varying the position of at least one of the side-walls with respect to the bottom.

5. The dry setting installation according to claim 4, wherein the system for varying the position of at least one of the side-walls with respect to the bottom comprises an additional positioning element fixed to the at least one side-wall and provided with an extending portion so as to fit in one of a plurality of grooves provided at predetermined distances in the bottom.

6. The dry setting installation according to claim 4, wherein the system for varying the position of at least one of the side-walls with respect to the bottom comprises an additional positioning element fixed to the at least one side-wall and arranged to provide a shiftable connection with a groove in the bottom for connecting the at least one side-wall to the bottom.

7. The dry setting installation according to claim 3, wherein the spacing variation system comprises at least one of an adjustable bottom and/or an adjustable back wall adjustable in length in its length direction.

8. The dry setting installation according to claim 7, wherein the adjustable bottom and/or the adjustable back wall is built up of segments and the length of the bottom and/or back wall is adjustable by adding or removing the segments.

9. The dry setting installation according to claim 1, wherein the distance variation system for varying the distance between the side edge sealing of the two side-walls comprises a position variation system for varying the relative position of at least one side edge sealing with respect to its side-wall.

10. The dry setting installation according to claim 9, wherein the position variation system is adapted for varying a relative position of the side edge sealing with respect to a seal support, the seal support being fixedly connected to the side-wall.

11. The dry setting installation according to claim 10, wherein the position variation system is arranged for varying a relative position of the seal support with respect to its side-wall, the seal being fixedly connected to the seal support.

12. A method for obtaining a dry working environment at an underwater structure, the method comprising obtaining an adjustable dry setting installation, setting a width of the adjustable dry setting installation by adjusting a distance between side edge sealing suitable for providing a sealing contact between side-walls and a wall of the underwater structure, and positioning the dry setting installation at the wall of the underwater structure.

13. The method according to claim 12, wherein setting a width is performed prior to positioning of the dry setting installation.

* * * * *